US007670736B2

(12) United States Patent
Yuh et al.

(10) Patent No.: US 7,670,736 B2
(45) Date of Patent: Mar. 2, 2010

(54) PHOTOCONDUCTORS

(75) Inventors: Huoy-Jen Yuh, Pittsford, NY (US); Robert C U Yu, Webster, NY (US); Yuhua Tong, Webster, NY (US); David M. Skinner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 356 days.

(21) Appl. No.: 11/729,641

(22) Filed: Mar. 29, 2007

(65) Prior Publication Data

US 2008/0241721 A1 Oct. 2, 2008

(51) Int. Cl.
*G03G 15/02* (2006.01)

(52) U.S. Cl. ..... 430/58.8; 430/58.75; 430/59.1; 430/59.5

(58) Field of Classification Search ..... 430/58.8, 430/58.75, 59.1, 59.4, 59.5
See application file for complete search history.

(56) References Cited

U.S. PATENT DOCUMENTS

| | | | | |
|---|---|---|---|---|
| 4,654,284 | A | 3/1987 | Yu et al. | |
| 5,096,795 | A | 3/1992 | Yu | |
| 5,919,590 | A | 7/1999 | Yu et al. | |
| 5,935,748 | A | 8/1999 | Yu et al. | |
| 6,303,254 | B1 | 10/2001 | Yu et al. | |
| 6,528,226 | B1 | 3/2003 | Yu et al. | |
| 6,913,863 | B2 | 7/2005 | Wu et al. | |
| 6,939,652 | B2 | 9/2005 | Yu | |
| 7,037,631 | B2 | 5/2006 | Wu et al. | |
| 7,524,597 | B2 * | 4/2009 | Mishra et al. | 430/58.8 |

* cited by examiner

*Primary Examiner*—John L Goodrow
(74) *Attorney, Agent, or Firm*—E. O. Palazzo

(57) ABSTRACT

A photoconductor containing a first layer, a supporting substrate thereover, a photogenerating layer, and at least one charge transport layer comprised of at least one charge transport component, and wherein the first layer is in contact with the supporting substrate on the reverse side thereof, and which layer contains a semi-penetrating polymer network formed from crosslinking a suitable fluoropolymer, and within which network structure is penetrated with a polycarbonate.

33 Claims, No Drawings

PHOTOCONDUCTORS

BACKGROUND

This disclosure is generally directed to layered imaging members, photoreceptors, photoconductors, and the like. More specifically, the present disclosure is directed to multilayered flexible, belt imaging members, or devices comprised of a first layer, a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an optional overcoating layer, and wherein the supporting substrate is situated between the first layer and the photogenerating layer. More specifically, the photoconductors disclosed contain a first anticurling layer or curl deterring back coating (ACBC) to render imaging member flatness, and which layer is in contact with and contiguous to the reverse side of the supporting substrate, that is this side of the substrate that is not in contact with the photogenerating layer and which first layer, the ACBC of present disclosure, is comprised of an interpenetrating, and more specifically, a semi-interpenetrating polymer network wherein a fluoropolymer like polyvinylfluroride, fluorinated polyethylene, or polyvinylidene fluoride form the network structure having a suitable polymer, such as a polycarbonate incorporated into the resulting crosslinked matrix.

In some instances, when a flexible layered photoconductor belt is mounted over a belt support module comprising various supporting rollers and backer bars in a xerographic imaging apparatus, the anticurl back coating (ACBC), functioning under a normal machine operation condition, is repeatedly subjected to mechanical sliding contact against the apparatus backer bars and the belt support module rollers, to thereby exacerbate ACBC wear characteristics. Moreover, with a number of known prior art ACBC photoconductor layers formulated to contain a polytetrafluoroethylene fluoride particle dispersion, there results mechanical interactions against the belt support module components which can generate electrostatic charge-up, causing substantial belt drive torque increases such that at times total belt cyclic motion stalling is incurred. A further disadvantage is that an ACBC coating solution prepared to contain a polytetrafluoroethylene fluoride particle dispersion can be difficult to effect a homogeneous particle dispersion, and these particles exhibit flocculation problems thereby adversely impacting the coating solution shelf life. To resolve these and other problems, especially as these problems relate to a number of known ACBC associated mechanical problems and other disadvantages, there is provided a novel ACBC layer with scratch and wear resistance and surface lubrication to effect a contact friction reduction with the belt support module components, and which ACBC layer comprises a polymer network, and more specifically, a semi-interpenetrating polymer network in which, for example, a fluoropolymer forms the network structure with a polycarbonate penetrating inside the crosslinked material matrix.

Also, attempting to enable photoconductors comprising an ACBC layer to simultaneously possess high surface lubricity, acceptable wear and scratch resistance properties has often been a challenge as the combination of material properties that would be favored to enhance one of the properties would usually undermine the other, thus reducing the materials design latitude. These and other disadvantages are eliminated or minimized with the photoconductors disclosed herein.

In embodiments, the photoconductor disclosed includes a curl deterring back coating or ACBC layer on the reverse side of the supporting substrate of a belt photoconductor. The ACBC layer, which can be solution coated, for example, as a self-adhesive layer, on the reverse side of the substrate of the photoreceptor, may comprise a number of suitable materials such as those components that minimize the surface contact friction reduction and prevent or minimize wear/scratch characteristics of the photoconductor device. In embodiments, the mechanically robust ACBC of the present disclosure usually will cause a reduction in the layer's thickness to the extent that will adversely effect its anticurling ability for maintaining an effective imaging member belt flatness, for example when not flat the ACBC layer can cause undesirable upward belt curling, which adversely impacts the imaging member belt surface charging uniformity, manifesting into print defects, which thereby prevent the imaging process from continuously providing a satisfactory copy printout quality. Moreover, ACBC wear also produces dirt and debris resulting in dusty machine operation condition. Since the ACBC layer is located on the reverse side of the photoconductor substrate, it does not usually adversely interfere with the xerographic performance of the photoconductor, and hence decouples the mechanical performance of this layer from the electrical performance of the photoconductor (which are generally mutually exclusive), and it separates the often conflicting requirements from the charge transport layer crack and scratch resistance, respectively, and therefore permits, for example, the efficient development and use of photoconductors with ACBC having an effective reduction in surface contact friction and excellent wear/scratch characteristics.

The photoconductors illustrated herein, in embodiments, have excellent wear resistance, surface lubrication for lowering contact friction, extended lifetimes, elimination or minimization of photoconductive imaging member belt ACBC scratches, and effecting the prevention of triboelectrostatic charge build-up thereby reducing the imaging member belt drive stalling issues during an imaging belt dynamic machine function.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Photoconductors containing anticurl layers are illustrated in U.S. Pat. Nos. 4,654,284; 5,096,795; 5,919,590; 5,935,748; 6,303,254; 6,528,226; and 6,939,652.

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer, and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,587,189, the disclosure of which is totally incorporated herein by reference, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid and then reprecipitating the resulting dissolved pigment in basic aqueous media.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, such as the supporting substrates, the photogenerating layer components, the charge transport layer components, the overcoating layer components, and the like of the above-recited patents, may be selected for the photoconductors of the present disclosure in embodiments thereof.

SUMMARY

Disclosed are improved imaging members containing a mechanically robust and surface lubricated ACBC layer that possesses many of the advantages illustrated herein, such as extended lifetimes of the ACBC photoconductor, such as for example, in excess of about 2,500,000 simulated imaging cycles without substantial exhibition of ACBC wear and scratch, or causing triboelectrostatic charge up imaging member inoperativeness, and the like.

Further disclosed are layered flexible photoresponsive imaging member belts with sensitivity to visible light and an ACBC layer with optical clarity for effectual back erase.

Additionally disclosed are flexible belt imaging members comprising the disclosed ACBC, and with optional hole blocking layers comprised of, for example, amino silanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor comprising a first layer, a flexible supporting substrate thereover, a photogenerating layer, and at least one charge transport layer comprised of at least one charge transport component, and wherein the first layer, which is an anticurl back coating (ACBC) for counteracting photoconductor curling, is in contact with the supporting substrate on the reverse side thereof, and which first layer is comprised of a fluoropolymer crosslinked network containing a polycarbonate inside the network structure to give a crosslinked semi-interpenetrating ACBC layer, and wherein the fluoropolymer is crosslinked, and which polymer is, for example, a fluorinated polyethylene, a copolymer of polyvinylidene fluoride and hexafluoropropylene, or mixtures thereof; a flexible imaging member comprising an ACBC layer in contact with the side of the substrate that is not in contact with the photogenerating layer, that is the reverse side of the substrate, a supporting substrate thereover, a photogenerating layer, and at least one charge transport layer comprised of at least one charge transport component; a flexible photoconductive imaging member comprised in sequence of an ACBC layer adhered to the reverse side of the supporting substrate, a supporting substrate, a photogenerating layer thereover, a charge transport layer, and a protective top overcoating layer; a photoconductor which includes a hole blocking layer and an adhesive layer where the adhesive layer is situated between the hole blocking layer and the photogenerating layer, and the hole blocking layer is situated between the substrate and the adhesive layer; and a photoconductor comprising a first layer, a supporting substrate thereover; a photogenerating layer, and at least one charge transport layer comprised of at least one charge transport component, and wherein the first layer is in contact with the supporting substrate on the reverse side thereof, and which first layer is comprised of an ally carbonate crosslinked fluoropolymer network interpenetrated with a polycarbonate, and wherein the fluoropolymer is comprised of at least one of a fluorinated polyethylene, a polyvinylidene fluoride, and a hexafluoropropylene; a photoconductor comprised in sequence of a supporting substrate, a photogenerating layer thereover, and a charge transport layer, and wherein the substrate includes on the reverse side thereof a first layer comprised of a suitable polymer such as a fluorinated polyethylene, a polyvinylidene fluoride, a polycarbonate, and a crosslinking agent of an ally carbonate; a photoconductor wherein the polycarbonate possesses a weight average molecular weight $M_w$ of from about 70,000 to about 250,000; a photoconductor wherein the fluoropolymer possesses a weight average molecular weight $M_w$ of from about 30,000 to about 100,000; a photoconductor wherein the crosslinking percentage is from about 20 to about 75 percent, and which crosslinking is achieved with a crosslinking agent of a vinyl containing carbonate as represented by Formula (I)

Formula (I)

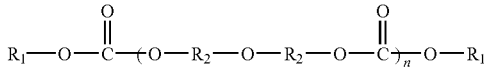

wherein $R_1$ is alkenyl, $R_2$ is alkyl, and n represents the number of repeating units; an organic carbonate of diethylene glycol bis(allyl carbonate) represented by Formula (II)

Formula (II)

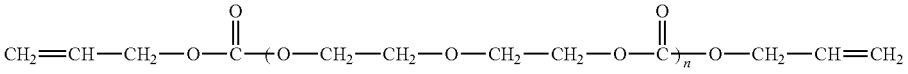

wherein n represents the number of repeating units; or an organic carbonate of an unsaturated aromatic carbonate represented by Formula (III)

Formula (III)

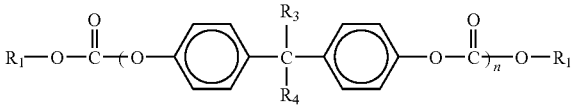

wherein $R_1$ is alkenyl; $R_3$ and $R_4$ are independently alkyl; and n represents the number of repeating units; or a bisphenol A derived allyl aromatic carbonate of Formula (IV)

Formula (IV)

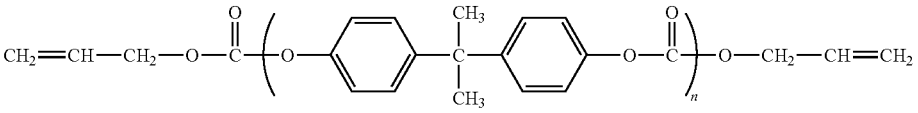

wherein n represents the number of repeating units; a photoconductor wherein the first layer is generated from about 0.8 to about 1.5 weight percent of a catalyst of a quaternary phosphonium salt, benzoyl peroxide, dicumyl peroxide, bis(2,4-dichlorobenzoyl)peroxide, di-benzoyl peroxide, dicumyl peroxide, di-tertiary butyl peroxide, 2,5-dimethyl-2,5-bis(t-butyl peroxide)hexane, dicyclohexyl peroxydicarbonate, isopropyl peroxydicarbonate, bis(4-terbutylcyclohexyl)peroxydicarbonate, or mixtures thereof; from about 0.8 to about 1.5 weight percent of a base; from about 10 to about 17 weight percent of an ally aromatic carbonate crosslinking agent of Formula (III); from about 10 to about 17 weight percent of the fluorinated polymer; and from about 70 to about 95 weight percent of the polycarbonate; and a photoconductor comprised in sequence of a supporting substrate, a photogenerating layer thereover, and a charge transport layer, and wherein the substrate includes a curl deterring back coating (ACBC) layer comprised of the crosslinked fluoropolymer

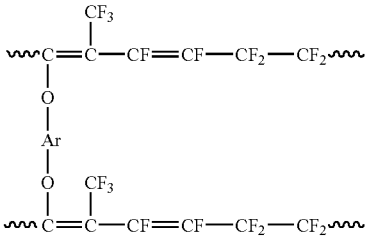

wherein Ar is aryl; and an ally aromatic carbonate.

The first layer adhered to the reverse side of the supporting substrate is comprised of, in embodiments, an interpenetrating, and more specifically, a semi-interpenetrating polymer network that includes a crosslinked fluoropolymer, for example a fluorinated polyethylene, such as VITON® GF (available from E.I. DuPont), a crosslinking agent of, for example, an ally carbonate, and also having a suitable polymer, such as a polycarbonate, penetrating inside the crosslinked structure of the fluoropolymer network matrix. An interpenetrating polymer network can be formed, for example, from a polymer blend of two compatible and independent crosslinked polymers of A and B; and in which the two crosslinked networks are interpenetrating and intertwining each other into a 3-dimensionally blended thermoset matrix. A semi-interpenetrating network usually has only a single crosslinked thermoset polymer network, and within which an uncrosslinked thermoplastic polymer is intertwinely penetrated inside the 3-dimensional network structure. Thus, in embodiments the semi-interpenetrating network is comprised of a thermoset crosslinked fluoropolymer network and a thermoplastic polymer present or contained inside the network matrix, and where the ACBC layer can be formed by selectively crosslinking the fluoropolymer molecules in the presence of a polycarbonate such that the resulting ACBC layer comprises a thermoset fluoropolymer network and a thermoplastic polycarbonate penetrating and intertwining the thermoset network structure. Typical fluoropolymers suitable for forming a thermoset network include, for example, fluorinated polyethylenes, copolymers of polyvinylidene fluoride, hexafluoropropylene, and mixtures thereof.

More specifically, the thermoset matrix can be generated as follows:

(1) a fluoropolymer, such as, for example, VITON® GF (available from E.I. DuPont), is first dissolved in an organic solvent, and the resulting solution is reacted with a base like $MgO/Ca(OH)_2$ to create conjugated dienes in the fluoropolymer chain backbone;

(2) an unsaturated carbonate compound, and more specifically, an unsaturated carbonate oligomer containing vinyl (or allyl) groups is added to the fluoropolymer solution (1). The primary function of the unsaturated or ally carbonate is to serve as a crosslinking agent permitting the formed linking intermediate to effect the connection of all the fluoropolymer chains into a network structure. The carbonate is selected from various molecular structures, which can be generally described by Formula (I)

Formula (I)

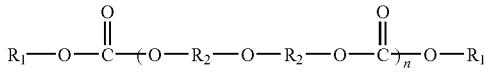

wherein $R_1$ is alkenyl with, for example, from about 2 to about 12 carbon atoms; $R_2$ is alkyl with, for example, from about 2 to about 12, and more specifically, with 2 or 3 carbon atoms, and n represents the number of repeating units, and can be a number of, for example, from about 1 to about 10, or from 1 to about 6.

The organic carbonate of Formula (I) in embodiments is a diethylene glycol bis(allyl carbonate) represented by Formula (II)

Formula (II)

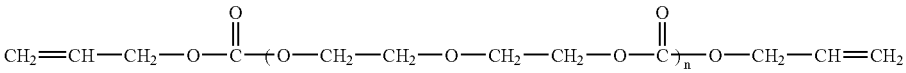

wherein n represents the number of repeating units, and is, for example, a number of from about 1 to about 10, and more specifically, from 1 to about 6; or the organic carbonate is an unsaturated aromatic carbonate represented by Formula (III)

FORMULA (III)

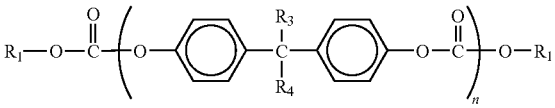

wherein $R_1$ is alkenyl with, for example, from about 2 to about 12, and more specifically, 2 to about 5 carbon atoms; $R_3$ and $R_4$ are independently alkyl with, for example, from about 1 to about 3 carbon atoms, and n is an integer of, for example, from about 1 to about 10, and more specifically, from 1 to about 6.

The organic carbonate of Formula (III) can be a monomer carbonate. Also, in embodiments, $R_3$ and $R_4$ are methyl, and $R_1$ is an allyl, thus the Formula (III) carbonate is a bis(allyl carbonate) of bisphenol A of Formula (IV)

FORMULA (IV)

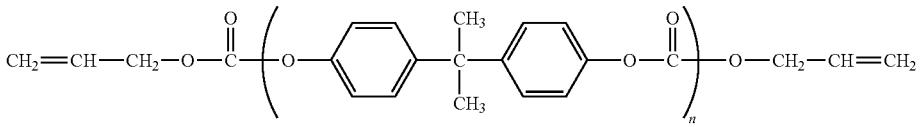

wherein n represents the number of repeating units of, for example, from about 1 to about 6, thus this Formula (IV) carbonate is available as HIRI™ from Pittsburg Plate Glass PPG;

(3) a selected polycarbonate is then introduced to the formed solution mixture. Typical polycarbonates suitable for this purpose are thermoplastics of poly(4,4'-isopropylidene diphenyl) carbonate referred to as bisphenol-A-polycarbonate and poly(4,4'-diphenyl-1,1'-cyclohexane) carbonate referred to as bisphenol-Z-polycarbonate, both with weight average molecular weights of from about 70,000 to about 250,000. Alternatively, polyphthalate carbonate (LEXAN® PPC 4701, available from General Electric Company) having the molecular formula below can be selected

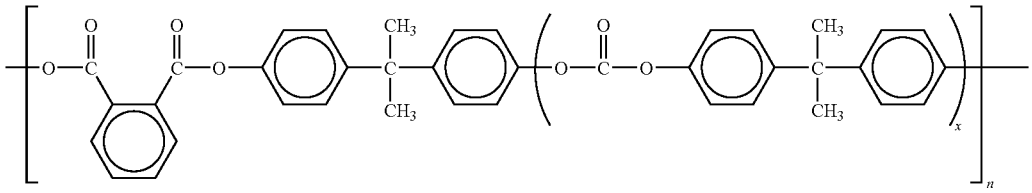

where x and n represent the number of repeating units, and more specifically, x is from about 20 and to about 100, and n is the degree of copolymerization of, for example, from about 10 to about 50. The polycarbonate used for the formulation of the ACBC layer can be a single component or a mixture of these components; and (4) there is selected as a curing or crosslinking catalyst a quaternary phosphonium salt (VC-50, available from E.I. DuPont de Nemours, Inc), benzoyl peroxide, dicumyl peroxide, bis(2,4-dichlorobenzoyl)peroxide, di-benzoyl peroxide, dicumyl peroxide, di-tertiary butyl peroxide, and 2,5-dimethyl-2,5-bis(t-butyl peroxide)hexane, dicyclohexyl peroxydicarbonate, isopropyl peroxydicarbonate, bis(4-terbutylcyclohexyl)peroxydicarbonate, mixtures thereof, and the like. Specific curing agents include, for example, basic metal oxides (MgO and $Ca(OH)_2$), and aliphatic and aromatic amines, where the aromatic groups may be benzene, toluene, naphthalene, anthracene, and the like. The catalyst is usually added into the solution mixture to catalyze and initiate the crosslinking reaction between the conjugated dienes of the fluoropolymer and the double bonds of the ally carbonate crosslinking agent into a thermoset network, which comprises the interlinking of both the fluoropolymer and the carbonate structure, and contains the thermoplastic polycarbonate intertwining inside its network structure after solution coating and elevated temperature drying. The weight average molecular weight ($M_w$) of the fluoropolymer is, for example, from about 30,000 to about 100,000 or from about 45,000 to about 75,000. For a typical flexible photoconductor imaging member design, the formulated ACBC has a thickness of from about 10 to about 30 microns, and more specifically, from about 15 to about 25 microns to enable, for example, excellent counteracting curling effect, and to maintain the photoconductor imaging member flatness.

The polycarbonate and the ally carbonates can in embodiments possess similar thermal/physical/mechanical properties, thus their incorporation into the fluoropolymer network matrix provides an ACBC layer with a surface energy lowering effect to render surface lubrication for a contact friction reduction, anticurling capability. Crosslinking provides, for example, surface scratch/wear resistance enhancement characteristics.

More specifically, the ACBC layer can be formed by mixing 6.4 grams of bisphenol-Z-polycarbonate (PCZ), 0.5 gram of a fluorinated polycarbonate, such as VITON® GF, 0.5 gram of a crosslinking agent of a vinyl containing bisphenol A carbonate of Formula (IV) wherein n is 1 (available as HIRI™ from Pittsburg Plate Glass, PPG), 0.1 gram of a crosslinking catalyst (VC-50™, bisphenol AF type), 0.1 gram of a strong base, such as $MgO/Ca(OH)_2$ in 1:2 ratio in a solvent mixture of 25.6 grams of THF/toluene in 8:2 ratio, and 5 grams of methyl isobutyl ketone. The resulting coating solution can then be hand coated on the reverse side of the photoconductor substrate, and then dried at 120° C. for one minute in an air circulating oven to produce a 20 microns thick dried ACBC layer with excellent desirable photoconductor flatness.

With a strong base selected in a suitable amount of, for example, from about 0.05 to about 0.15 gram like $MgO/Ca(OH)_2$, basic metal oxides, aliphatic amines, aromatic amines, and the like where aromatic is, for example, benzene toluene, naphthalene, anthracene, and the like, a conjugated diene as represented by the following formula/structure can be created in the main molecular chain of the fluoropolymer dissolved, for example, in a ketone like methyl isobutyl ketone

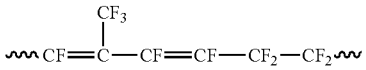

and which diene structures together with the added ally carbonate can be crosslinked by a di-nucleophilic component, such as a bisphenol and a diamine, resulting in the formation of a thermoset crosslinked fluoropolymer network of

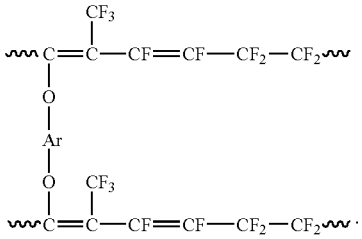

Although not being desired to be limited by theory, it is believed that in the created thermoset crosslinked fluoropolymer network structure the thermoplastic polycarbonate is present and physically intertwining, but not chemically bonded, into the network matrix. The formulated ACBC layer can in embodiments be considered a semi-interpenetrating crosslinked network with HIRI® as the linking agent to create a fluoropolymer network structure with the polycarbonate like PCZ being present inside this network matrix. The resulting ACBC layer after solution application onto the reverse side of, for example, a 3½ mil (or about 88.9 microns) thick polyethylene naphthalate (PEN) substrate, and dried at elevated temperature possessed excellent adhesion bonding to the PEN substrate of approximately a 55 grams/centimeter 180° peel strength. The created ACBC layer also has a slippery surface to the touch of a hand to thereby render its contact friction reduction for effective triboelectrical charging elimination or minimization.

The ACBC layer was further assessed for its surface scratch resistance as illustrated hereinafter in the Lab Examples, determined by utilizing a stylus surface scratching test method. More specifically, the formed ACBC layer was placed (with its surface facing upwardly) on a flat platform, and a stainless steel phonographic needle under a control 6 gram load was then allowed to slide over the ACBC surface at a constant speed of 4 inches/minute to induce a surface scratch. The surface scratch was measured to sustain such a load to create a scratch depth of about 0.12 micron. As a comparison, a known photoconductor ACBC containing a 10 percent PTFE dispersion tested under the same conditions produced a deeper scratch depth of 0.38 micron.

The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns ("about" throughout includes all values in between the values recited), or of a minimum thickness. In embodiments, the thickness of this layer is from about 75 microns to about 300 microns, or from about 100 to about 150 microns.

The photoconductor substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose, including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon, and compounds of silicon and germanium, carbon, oxygen, nitrogen, and the like fabricated by vacuum evaporation or deposition. The photogenerating layers may also comprise inorganic pigments of crystalline selenium, and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

Phthalocyanines have been selected as photogenerating materials for use in laser printers using infrared exposure systems. Infrared sensitivity is usually desired for photoreceptors exposed to low cost semiconductor laser diode light exposure devices. The absorption spectrum and photosensitivity of the phthalocyanines depend on the central metal atom of the compound. A number of metal phthalocyanines, which can be included in the photogenerating layer of the disclosed photoconductors, are oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine, and metal free phthalocyanine. The phthalocyanines exist in many crystal forms, and have a strong influence on photogeneration.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The coating of the photogenerating layer in embodiments of the present disclosure can be accomplished with spray, dip, or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer), and the underlying conductive surface of substrate may be selected.

A number of charge transport compounds can be included in the charge transport layer, which layer generally is of a thickness of from about 5 microns to about 75 microns, and more specifically, of a thickness of from about 10 microns to about 40 microns. Examples of charge transport components are aryl amines of the following formulas/structures

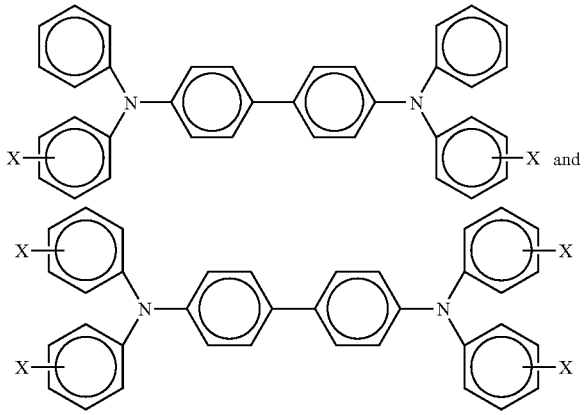

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

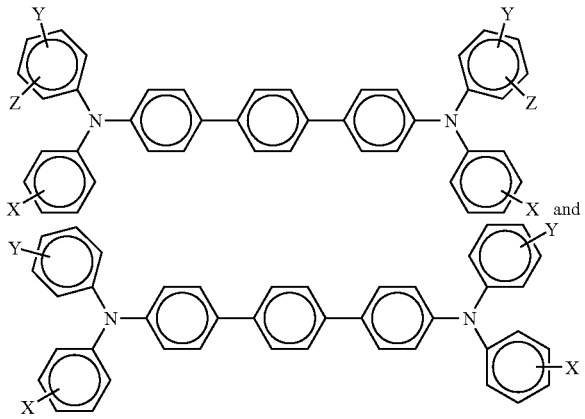

wherein X, Y and Z are independently alkyl, alkoxy, aryl, a halogen, or mixtures thereof, and in embodiments wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl) carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material or a combination of a small molecule charge transport material and a polymeric charge transport material.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is from about 10 to about 70 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional overcoating may be applied over the charge transport layer to provide abrasion protection. The dried overcoating layer should transport holes during imaging, and should not have too high a free carrier concentration. Free carrier concentration in the overcoat increases the dark decay.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoating charge transport layer, and where the transport layer is of a thickness of from about 40 to about 75 microns; a photoconductor member wherein the photogenerating layer contains a photogenerating pigment present in an amount of from about 5 to about 95 weight percent; a member wherein the thickness of the photogenerating layer is from about 0.1 to about 4 microns; a photoconductor wherein the photogenerating layer contains a polymer binder; a member wherein the binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; a photoconductor wherein the supporting substrate is comprised of a conductive substrate comprised of a metal; a photoconductor wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers comprises

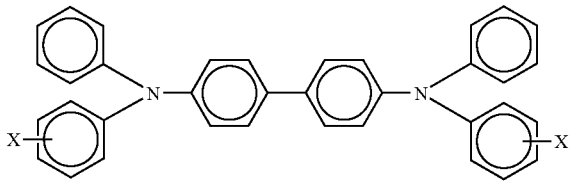

wherein X is selected from the group consisting of alkyl, alkoxy, aryl, and halogen; an imaging member wherein the charge transport alkyl and alkoxy contains from about 1 to about 12 carbon atoms; an imaging member wherein alkyl contains from about 1 to about 5 carbon atoms; an imaging member wherein alkyl is methyl; an imaging member wherein each of or at least one of the charge transport layers comprises

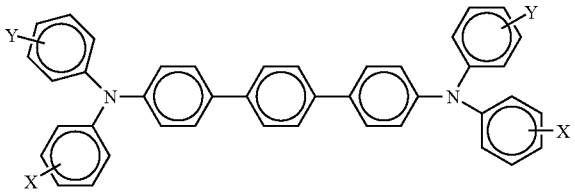

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport; a photoconductor wherein the charge transport layer is situated between the substrate and the photogenerating layer; a photoconductor member wherein the photogenerating layer is of a thickness of from about 0.1 to about 50 microns; a member wherein the photogenerating component amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N, N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring and fixing the developed electrostatic image to a suitable substrate; photoconductive imaging members comprised of a supporting substrate, a photogenerating layer, a hole transport layer, and a top overcoating layer in contact with the hole transport layer or in embodiments in contact with the photogenerating layer, and in embodiments wherein a plurality of charge transport layers are selected, such as for example, from two to about ten, and more specifically two may be selected; and a photoconductive imaging member comprised of an optional supporting substrate, a photogenerating layer, and a first, second, and third charge transport layer.

Examples of components or materials optionally incorporated into the charge transport layer or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA™, STAB AO-20, AO-30, AO-40 AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36TM, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the layers, specifically disclosed herein are not intended to be exhaustive. Thus, a number of components, polymers, formulas, structures, and R group or substituent examples and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups, and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42 or more. Similarly, the thickness of each of the layers, the examples of components in each of the layers, the amount ranges of each of the components disclosed and claimed is not exhaustive, and it is intended that the present disclosure and claims encompass other suitable parameters not disclosed, or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

COMPARATIVE EXAMPLE

A photoconductor imaging member was prepared by providing a 0.02 micrometer thick titanium layer coated (the coater device) on a biaxially oriented polyethylene naphthalate substrate (PEN, KALEDEX™ 2000) having a thickness of 3.5 mils; and applying thereon the above titanium layer, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator, and which adhesive contains 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mils. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry photogenerating layer having a thickness of 0.4 micron.

The photoconductor imaging member web was then coated over with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl) carbonate, a known bisphenol A polycarbonate having a molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

The resulting photoconductor imaging member web stock, at this point if unrestrained, would spontaneously curl upwardly into a 1½ inch diameter tube. A 19 micron thick prior art ACBC control, containing 92 percent by weight of MAKROLON®, 8 percent by weight of copolyester adhesion promoter (available from Bostik, Inc. Middleton, Mass.), and 10 percent by weight of a PTFE particle dispersion, was applied to the underneath side of the PEN substrate support.

EXAMPLE I

A photoconductor member was prepared by following the same procedures and utilizing the same materials as those described in the above Comparative Example, with the exception that the ACBC layer was replaced with a novel semi-penetrating crosslinked network ACBC design, formulated according to the material composition and preparation method of the present disclosure. The resulting photoconductor containing the semi-interpenetrating network ACBC was flat (about 180 degrees) in its orientation.

The above semi-interpenetrating polymer network ACBC layer composition was prepared by dissolving 0.5 gram of the fluoropolymer fluorinated polyethylene VITON® GF (available from E.I. DuPont) in 5 grams of methyl isobutyl ketone [MIBK] resulting in a clear solution. To this solution, 0.033 gram of MgO and 0.067 gram of $Ca(OH)_2$ were added, and the solution became cloudy. The resulting cloudy solution was mixed at 23° C. with constant agitation for 2 hours to create conjugated dienes in the fluoropolymer chain backbone. Subsequently, 0.1 gram of the curing catalyst of VC-50™ (from E.I. DuPont) was then added into the solution with mixing at 23° C. for another 15 minutes. The resulting MIBK solution, containing the above materials mixture, was then added into a solution that was prepared and comprised of 6.4 grams of bisphenol-Z-polycarbonate (PCZ-500 available from Mitsubishi) and 0.5 gram of the vinyl containing bisphenol A carbonate of Formula (IV) wherein n is 1 (available as HIRI® from Pittsburg Plate Glass, PPG), dissolved in 25.6 grams of a tetrahydrofuran/toluene solvent mixture in 8:2 ratio by weight. The resulting mixture was then stirred at 4,500 rpm for 3 minutes to obtain a viscous coating solution. The solution was hand coated on the underneath side of the PEN substrate, using a 4.5 mil bar, and dried at 120° C. for one minute in an air circulating oven to produce an optically clear 20 microns thick dried semi-penetrating network ACBC composition.

The formulated ACBC was a semi-interpenetrating crosslinked network with HIRI™ as the linking agent creating a fluoropolymer network structure and having the PCZ present inside this network matrix; that is, the resulting ACBC was comprised of a thermoset crosslinked VITON® GF-HIRI® network and a thermoplastic bisphenol-Z-polycarbonate (PCZ) homogeneously penetrating and intertwining inside the network structure.

Photoelectrical Property Assessment

The above prepared photoconductor imaging members of the Comparative Example and Example I were both tested in a scanner set to obtain photoinduced discharge cycles, sequenced at one charge-erase cycle, followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were also obtained by a series of charge-erase cycles with incrementing surface potential to generate several voltage versus charge density curves. The scanner was equipped with a scorotron set to a constant voltage charging at various surface potentials. The imaging members were tested at surface potentials of 500 with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The photoinduced discharge characteristic (PIDC) curves were then generated.

The results obtained from the photoelectrical testing for both photoconductor imaging members were virtually identical, indicating that the important photoelectrical functions of the imaging member were essentially maintained when a standard ACBC control was replaced with the Example I ACBC layer. The ACBC layer of Example I was present on the underneath side of the PEN substrate support for the primary purpose of providing mechanical anticurling effect.

Scratch Resistance and Adhesion Measurement

The formulated photoconductor with the ACBC semi-interpenetrating crosslinked network structure of Example I was assessed for its surface scratch resistance, determined by utilizing a stylus surface scratching test method. The ACBC layer was laid down (with its surface facing upwardly) on a flat platform, a stainless steel phonographic needle under a control 6 gram load was then allowed to slide over the ACBC surface at a constant speed of 4 inches/minute to induce a surface scratch. The scratch thus created was measured to have a 0.12 micron of scratch depth. By comparison, a prior art ACBC layer containing 10 percent by weight of the PTFE dispersion, reference the Comparative Example tested under the same conditions, was found to sustain a much deeper scratch depth of 0.38 micron. These results indicated, for example, that the Example I ACBC was a much harder material than the Comparative Example ACBC control counterpart, especially as applicable to wear resistance, thus enabling an ACBC service life extension for the Example I photoconductor, and eliminating or minimizing the undesirable propensity of the photoconductor imaging member belt to curl upwards, which upward curling causes copy print out defects, as a consequence of nonuniform imaging member surface charging from the effect of ACBC wear thickness reduction during dynamic belt function.

The ACBC layer was further tested to determine its adhesion bond strength to the PEN substrate, which adhesion measurement was initiated at 180° angles of peel test. The peel-test was measured as 55 grams/centimeter ACBC bond strength to the substrate. This exceeded an ACBC adhesion specification of 5 grams/centimeter of a known photoconductor like that of the Comparative Example. No ACBC delamination was observed with the Example I photoconductor belt in the Xerox Corporation iGEN® machine for extended imaging cycles. Also, as the ACBC contained the VITON® fluoropolymer as the network structure, its surface was slippery to the touch. Further, the Example I ACBC surface lubricity allowed a contact friction reduction suppressing ACBC wear caused by its sliding mechanical action against the xerographic belt support module components. A reduction in surface contact friction should also provide an added benefit of eliminating the ACBC triboelectrical charging up thereby minimizing the dynamic photoconductor belt cycling belt stalling, that is not operating continuously.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a first layer, a supporting substrate thereover, a photogenerating layer, and at least one charge transport layer comprised of at least one charge transport component, and wherein said first layer is in contact with said supporting substrate on the reverse side thereof, and which first layer is comprised of an allyl carbonate crosslinked fluoropolymer network interpenetrated with a polycarbonate, and wherein said fluoropolymer is comprised of at least one of a fluorinated polyethylene, a polyvinylidene fluoride, and a hexafluoropropylene.

2. A photoconductor in accordance with claim 1 wherein said polycarbonate possesses a weight average molecular weight $M_w$ of from about 70,000 to about 250,000.

3. A photoconductor in accordance with claim 1 wherein said fluoropolymer possesses a weight average molecular weight $M_w$ of from about 30,000 to about 100,000.

4. A photoconductor in accordance with claim 1 wherein said polycarbonate is at least one of poly(4,4'-isopropylidene diphenyl) carbonate, poly(4,4'-diphenyl-1,1'-cyclohexane) carbonate, and a polyphthalate carbonate as represented by

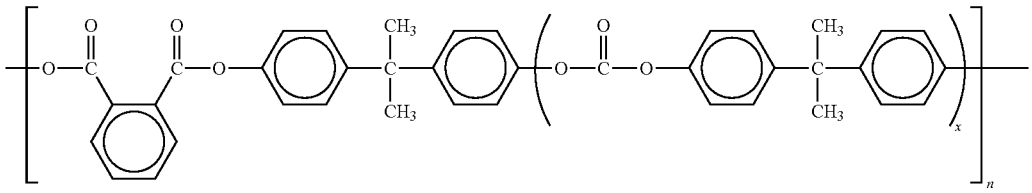

wherein x is a number of from about 20 to about 100, and n is the degree of copolymerization and is from about 10 to about 50, and said first layer is located opposite the supporting substrate surface not in contact with the photogenerating layer.

5. A photoconductor in accordance with claim 1 wherein said first layer and said supporting substrate are each comprised of a single layer, said first layer is in the form of an interpenetrating network, and said allyl carbonate is an oligomer.

6. A photoconductor in accordance with claim 1 wherein said crosslinking percentage is from about 20 to about 75 percent, and which crosslinking is achieved with a crosslinking agent and said allyl carbonate as represented by Formula (I)

Formula (I)

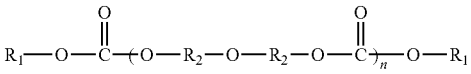

wherein $R_1$ is alkenyl, $R_2$ is alkyl, and n represents the number of repeating units; an organic carbonate of diethylene glycol bis(allyl carbonate) represented by Formula (II)

Formula (II)

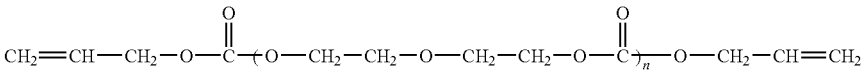

wherein n represents the number of repeating units; or an organic carbonate of an unsaturated aromatic carbonate represented by Formula (III)

Formula (III)

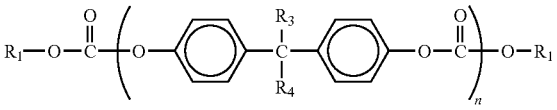

wherein $R_1$ is alkenyl; $R_3$ and $R_4$ are independently alkyl; and n represents the number of repeating units; or a bisphenol A derived allyl aromatic carbonate of Formula (IV)

Formula (IV)

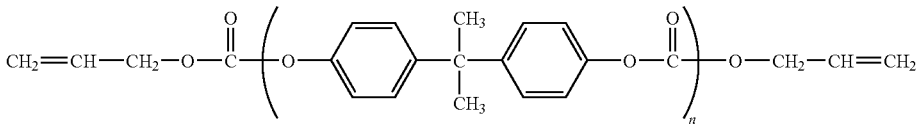

wherein n represents the number of repeating units.

7. A photoconductor in accordance with claim 1 wherein said charge transport component is comprised of at least one of aryl amine molecules

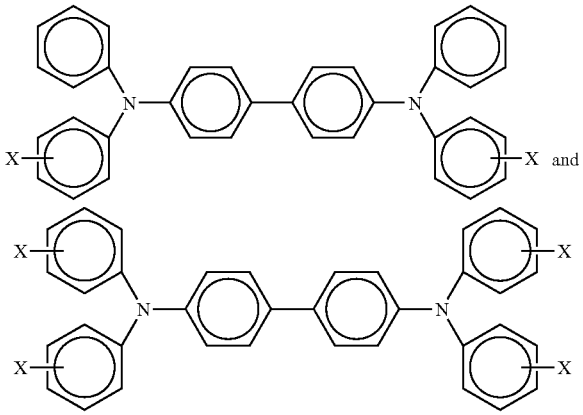

wherein X is selected from the group consisting of alkyl, alkoxy, aryl, halogen, and mixtures thereof.

8. A photoconductor in accordance with claim 7 wherein said alkyl and said alkoxy each contains from about 1 to about 12 carbon atoms, and said aryl contains from about 6 to about 36 carbon atoms.

9. A photoconductor in accordance with claim 7 wherein said aryl amine is N,N'-diphenyl-N,N-bis(3-methylphenyl)-1,1'-biphenyl-4,4'-diamine.

10. A photoconductor in accordance with claim 1 wherein said charge transport component is comprised of

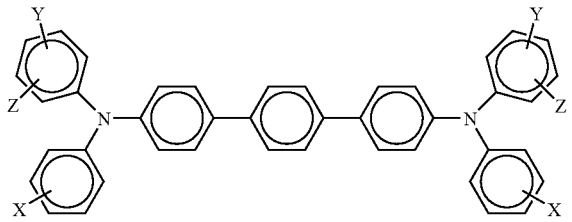

wherein X, Y and Z are independently selected from the group consisting of alkyl, alkoxy, aryl, and halogen.

11. A photoconductor in accordance with claim 10 wherein alkyl and alkoxy each contains from about 1 to about 12 carbon atoms, and aryl contains from about 6 to about 36 carbon atoms.

12. A photoconductor in accordance with claim 10 wherein said charge transport component is an aryl amine selected from the group consisting of N,N-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]4,4"-diamine, N,N'-bis(4-butylphenyl)-N,N'-bis-(4-isopropylphenyl)[p-terphenyl]-4,4"-diamine, bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and mixtures thereof.

13. A photoconductor in accordance with claim 1 wherein said charge transport component is comprised of aryl amine mixtures.

14. A photoconductor in accordance with claim 1 wherein said member further includes in at least one of said charge transport layers an antioxidant comprised of a hindered phenolic and a hindered amine.

15. A photoconductor in accordance with claim 1 wherein said photogenerating layer is comprised of a photogenerating pigment or photogenerating pigments.

16. A photoconductor in accordance with claim 15 wherein said photogenerating pigment is comprised of at least one of a metal phthalocyanine, a metal free phthalocyanine, a titanyl phthalocyanine, a halogallium phthalocyanine, a perylene, or mixtures thereof.

17. A photoconductor in accordance with claim 15 wherein said photogenerating pigment is comprised of chlorogallium phthalocyanine.

18. A photoconductor in accordance with claim 15 wherein said photogenerating pigment is comprised of hydroxygallium phthalocyanine.

19. A photoconductor in accordance with claim 1 further including a hole blocking layer, and an adhesive layer.

20. A photoconductor in accordance with claim 1 wherein said substrate is a flexible web.

21. A photoconductor in accordance with claim 1 wherein said at least one charge transport layer is from 1 to about 7 layers, and said first layer is in the form of a semi-interpenetrating network.

22. A photoconductor in accordance with claim 1 wherein said at least one charge transport layer is from 1 to about 2 layers.

23. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

24. A photoconductor consisting essentially of and in sequence of a supporting substrate, a photogenerating layer thereover, and a charge transport layer, and wherein said substrate includes on the reverse side thereof a first layer comprised of a crosslinking agent, and an allyl carbonate crosslinked fluoropolymer network interpenetrated with said allyl carbonate and where said fluoropolymer is selected from the group consisting of a fluorinated polyethylene, and a polyvinylidene fluoride, said crosslinking percentage is from about 25 to about 75 percent, and wherein said allyl carbonate is represented by Formula (I)

Formula (I)

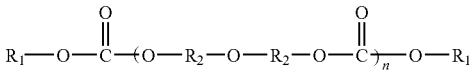

wherein $R_1$ is alkenyl, $R_2$ is alkyl, and n represents the number of repeating units; an organic carbonate of diethylene glycol bis(allyl carbonate) represented by Formula (II)

Formula (II)

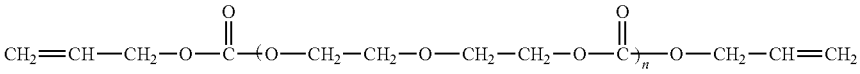

wherein n represents the number of repeating units; or an organic carbonate of an unsaturated aromatic carbonate represented by Formula (III)

Formula (III)

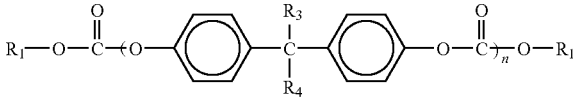

wherein $R_1$ is alkenyl; $R_3$ and $R_4$ are independently alkyl; and n represents the number of repeating units; or a bisphenol A derived allyl aromatic carbonate of Formula (IV)

Formula (IV)

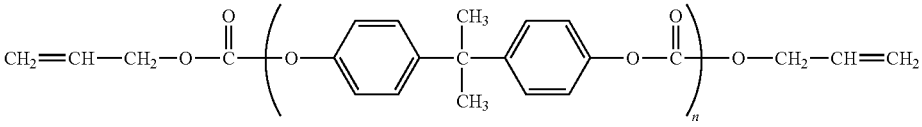

wherein n represents the number of repeating units, or said allyl carbonate is represented by Formula (IV)

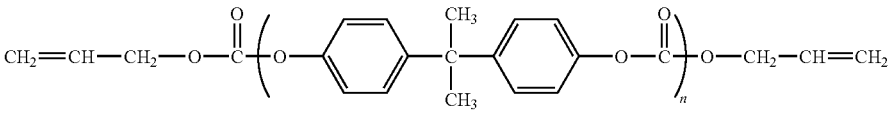

wherein n is 1.

25. A photoconductor in accordance with claim 24 wherein said first layer is a semi-interpenetrating polymer network substantially permanently adhered to said reverse side of said substrate, and said supporting layer includes a conductive surface layer on its front side, and wherein said first layer and said supporting substrate are each comprised of a single layer.

26. A photoconductor in accordance with claim 24 wherein said first layer is generated from about 0.8 to about 1.5 weight percent of a catalyst of a quaternary phosphonium salt, benzoyl peroxide, dicumyl peroxide, bis(2,4-dichlorobenzoyl) peroxide, di-benzoyl peroxide, dicumyl peroxide, di-tertiary butyl peroxide, 2,5-dimethyl-2,5-bis(t-butyl peroxide)hexane, dicyclohexyl peroxydicarbonate, isopropyl peroxydicarbonate, bis(4-terbutylcyclohexyl) peroxydicarbonate, or mixtures thereof; from about 0.8 to about 1.5 weight percent of a base; from about 10 to about 17 weight percent of an ally aromatic carbonate crosslinking agent of Formula (III); from about 10 to about 17 weight percent of the fluorinated polymer; and from about 70 to about 95 weight percent of the polycarbonate.

27. A photoconductor in accordance with claim 24 wherein the first layer is further comprised of about 1.3 weight percent of the catalyst; about 1.3 weight percent of $MgO/Ca(OH)_2$, about 13 weight percent of the ally aromatic carbonate of Formula (IV), about 10 to about 13 weight percent of the fluorinated polyethylene, and about 84 weight percent of poly(4,4'-diphenyl-1,1'-cyclohexane) carbonate.

28. A photoconductor in accordance with claim 24 wherein the first layer has a thickness of from about 10 to about 30 microns.

29. A photoconductor comprised in sequence of a supporting substrate, a photogenerating layer thereover, and a charge transport layer, and wherein said substrate includes a curl deterring back coating (ACBC) layer comprised of the crosslinked fluoropolymer

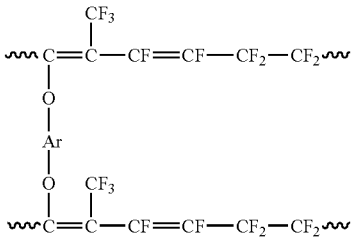

wherein Ar is aryl; and an allyl aromatic carbonate.

30. A photoconductor in accordance with claim 1 wherein said ally carbonate is an oligomeric ally aromatic carbonate of Formula (IV)

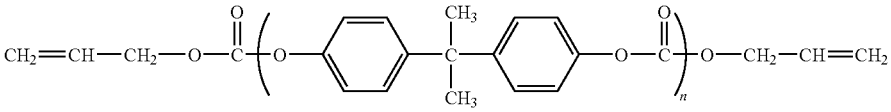

Formula (IV)

wherein n is 1.

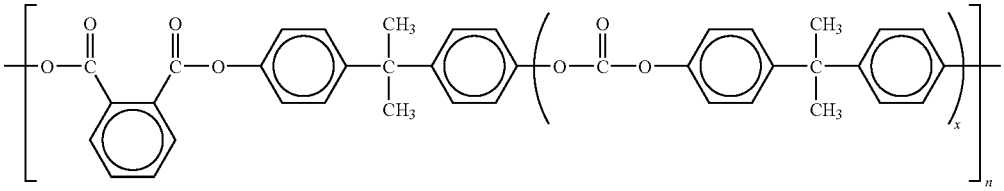

31. A photoconductor in accordance with claim 6 said first layer has a thickness of from about 10 and about 30 microns, wherein alkenyl contains from about 2 to about 5 carbon atoms, alkyl contains from about 2 to about 4 carbon atoms, and n is a number of from 1 to about 6.

32. A photoconductor in accordance with claim 1 wherein said first layer is formed by the dissolution of said layer components in at least one suitable solvent in the presence of a catalyst, and which layer is comprised of from about 0.5 to about 2 weight percent of a catalyst of at least one of a quaternary phosphonium salt, benzoyl peroxide, dicumyl peroxide, bis(2,4-dichlorobenzoyl) peroxide, di-benzoyl peroxide, dicumyl peroxide, di-tertiary butyl peroxide, 2,5-dimethyl-2,5-bis(t-butyl peroxide)hexane, dicyclohexyl peroxydicarbonate, isopropyl peroxydicarbonate, and bis(4-tertiary butylcyclohexyl)peroxydicarbonate; and which first layer further includes from about 1 to about 2 weight percent of the base $MgO/Ca(OH)_2$; from about 10 to about 18 weight percent of the ally aromatic carbonate of Formula (III); from about 9 to about 17 weight percent of the fluorinated polymer; and from about 75 to about 85 weight percent of the polycarbonate poly-(4,4'-diphenyl-1,1'-cyclohexane) carbonate.

33. A photoconductor in accordance with claim 24 wherein said fluoropolymer is a fluorinated polyethylene and wherein said polycarbonate is at least one of poly(4,4'-isopropylidene diphenyl) carbonate poly-(4,4'-diphenyl-1,1'-cyclohexane) carbonate, and a poly-phthalate carbonate as represented by wherein x is a number of from about 20 to about 100, and n is the degree of copolymerization and is from about 10 to about 50, and said first layer is located opposite the supporting substrate surface not in contact with the photogenerating layer.

* * * * *